United States Patent [19]

Gilbert

[11] Patent Number: 4,472,890

[45] **Date of Patent: * Sep. 25, 1984**

[54] SHOE INCORPORATING SHOCK ABSORBING PARTIALLY LIQUID-FILLED CUSHIONS

[75] Inventor: Sam Gilbert, Pacific Palisades, Calif.

[73] Assignee: Fivel, Encino, Calif.

[ * ] Notice: The portion of the term of this patent subsequent to Aug. 3, 1999 has been disclaimed.

[21] Appl. No.: 473,275

[22] Filed: Mar. 8, 1983

[51] Int. Cl.[3] ..... A43B 13/20; A43B 21/26

[52] U.S. Cl. ..... 36/28; 36/29; 36/35 B; 128/594

[58] Field of Search ..... 36/29, 28, 3 B, 43, 36/44; 128/594, 595

[56] References Cited

U.S. PATENT DOCUMENTS

| | | | |
|---|---|---|---|
| 1,193,608 | 8/1916 | Poulson | 36/29 |
| 2,055,072 | 9/1936 | Everston | 36/28 |
| 3,417,494 | 12/1968 | Claff | 36/3 B |
| 4,237,625 | 12/1980 | Cole et al. | 36/29 |
| 4,312,140 | 1/1982 | Reber | 36/3 B |
| 4,342,157 | 8/1982 | Gilbert | 36/29 |
| 4,358,902 | 11/1982 | Cole et al. | 36/28 |

*Primary Examiner*—Werner H. Schroeder
*Assistant Examiner*—Steven N. Meyers
*Attorney, Agent, or Firm*—Robert Louis Finkel

[57] ABSTRACT

A pair of thin-walled hollow partially liquid-filled cushions are enclosed in cavities formed in the sole of a shoe. The first cushion is positioned to coincide with the plantar pads on the lower sides of the wearer's metatarsals; the second to coincide with the tuberosity of the wearer's calcaneum.

10 Claims, 5 Drawing Figures

FIG. 1
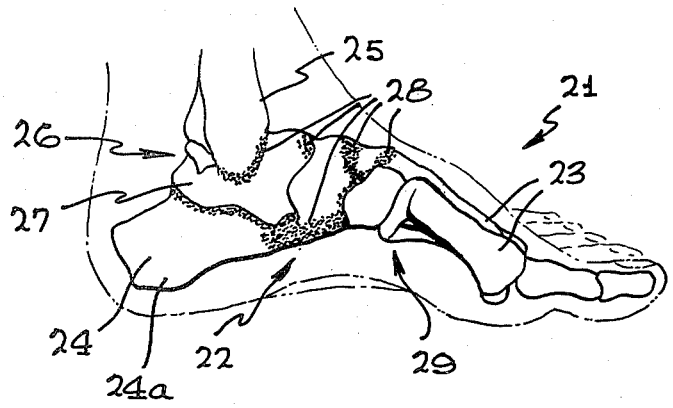
FIG. 2
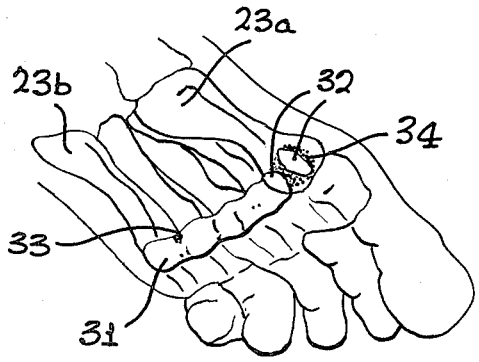
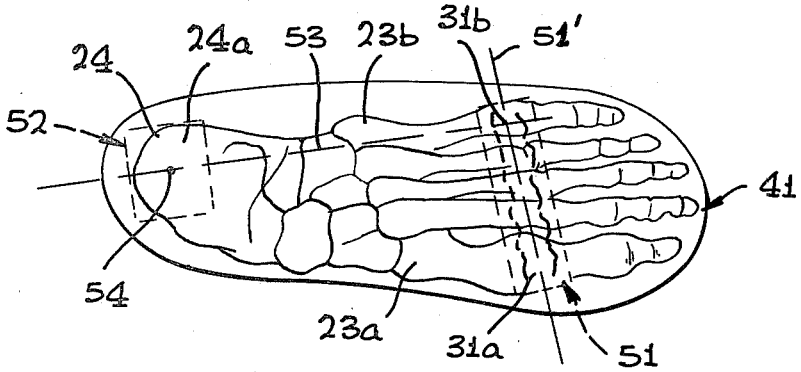
FIG. 3

FIG. 4
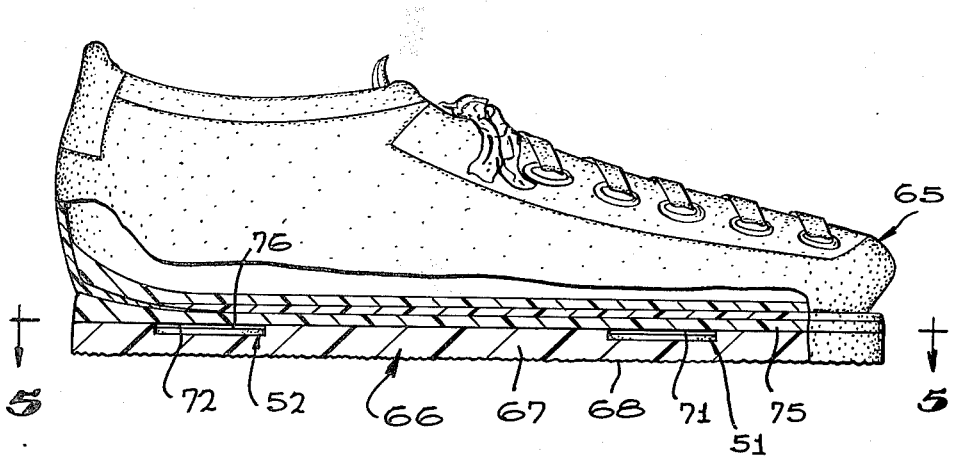
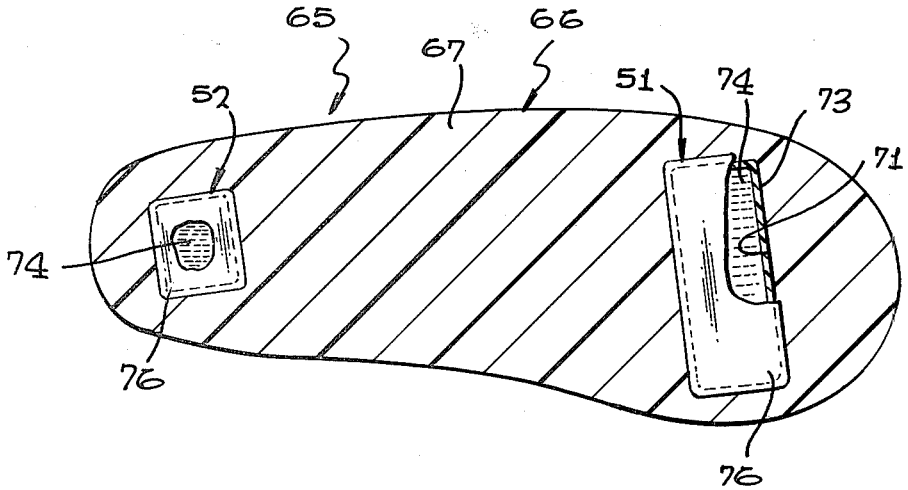
FIG. 5

SHOE INCORPORATING SHOCK ABSORBING PARTIALLY LIQUID-FILLED CUSHIONS

BACKGROUND OF THE INVENTION

1. Field of the Invention

This invention relates to shoes incorporating shock absorbing cushions, and more particularly to shoes in which such cushions are of the partially liquid-filled type described in my U.S. Pat. No. 4,342,157, issued 3 Aug. 1982.

2. Prior Art

Since my patented cushions have only recently become known to the public, the prior art offers few, if any ideas as to their use. Experimentation has demonstrated to me that their unique construction provides a shock absorbing effect quite unlike that produced by customary prior art resilient pads, including those which contained entrapped fluids. I believe, although I am not certain, that the interaction between the thin resilient walls, top and bottom of the cushion and the adjacent walls, roof and floor of the sole cavity in which they are contained serves to enhance the resilience of the cushion in directions normal to the walls of the cavity. Whatever the explanation, I have found that the positioning and alignment of the cushion under the ball and heel of the wearer's foot has a great deal to do with the effectiveness of the device. The principal object of the subject invention is to provide a shoe incorporating my patented cushion, which utilizes its shock absorbing capability to the fullest extent possible.

BRIEF SUMMARY OF THE INVENTION

To achieve the result sought, I have concluded that the most satisfactory arrangement employs two of my cushions. The first is positioned in the shoe sole to lie directly under the plantar pads on the lower side of the wearer's metatarsal bones. Based on my observations, this normally requires that the longitudinal axis of the pad form an angle of from about 90° to about 100° with the imaginary line connecting the center of the pad under the wearer's fifth metatarsal bone and the center of the undereside of wearer's heel bone, i.e., the tuberosity of the calcaneum. The second cushion is positoned directly under the heel bone, preferably in alignment with the previously mentioned imaginary line. The cushions may be built into the shoe sole at the time the shoe is being manufactured, or may be incorporated in a separate sole adapted for insertion into the shoe at a later time.

Other objects and features of the invention will become apparent to the reader from the following detailed description of the preferred embodiment of the invention as illustrated in the accompanying set of drawings.

DESCRIPTION OF THE DRAWINGS

In the drawings:

FIG. 1 is a perspective view of the medial or inner side of the left foot, showing the principal bones of the foot.

FIG. 2 is a partial perspective view of the underside of a foot, showing the location of the plantar pads on the lower sides of the heads of the metatarsal bones.

FIG. 3 is a top plan view showing the positions of the cushions in my invention with respect to the bony structure of the foot, and more particularly with respect to the plantar pads.

FIG. 4 is a side elevation of a shoe incorporating my cushions in accordance with this invention, with portions cut away for illustrative purposes.

FIG. 5 is a top sectional view of the shoe of FIG. 4, taken in the direction 5—5, with portions cut away for illustrative purposes.

DETAILED DESCRIPTION OF THE PREFERRED EMBODIMENT

Referring to FIG. 1, the foot 21 includes a hind portion or tarsus 22 made up of a series of small tarsal bones, a fore portion comprising the metatarsals 23, and the calcaneum or heel bone 24. The tarsal bones are articulated to permit movements of inversion and eversion, and in turn support the lower ends of the leg bones 25 at the hinged ankle joint 26 formed with the talus 27. Ligaments 28 connecting the tarsals and metatarsals, aided by the muscles and superficial tissue, give the foot a pronounced arch 29, particularly on its medial side. The talus 27 forms the summit of the arch and distributes the weight of the body posteriorly to the calcaneum and anteriorly, through the remaining tarsal bones, to the metatarsals.

As best seen in FIG. 2, the heads of the metatarsals 23 rest on a series of plantar pads 31, in the first of which the two sesamoid bones 32 are developed. The pads 31 are bound together by four transverse ligaments 33. The head of the first metatarsal **23*a* is marked by a pair of grooves (not shown) separated by a ridge, and the sesamoids 32 are held in the grooves by ligaments 34** attaching them to the head of the metatarsal bone.

So long as this mechanism is intact the first metatarsal is held in place, but if the ligaments 34 become stretched the first metatarsal **23*a* may diverge medially. This is especially likely to occur in athletes and workers who subject their feet to continuous or frequent high-impact forces, as in running, jumping and carrying heavy loads, and in women who wear high-heeled shoes, since the elevation of the proximal ends of the metatarsals associated with such activities places great strain on these ligaments 34. Eventually the sesamoids may be permanetly disarticulated from their grooves and the metatarsal 23*a*** freed, so that its head comes to project prominently and carries a bunion, while the great toe itself is forced laterally by the curved or pointed toe of the shoe.

Because of their intricate structure and complex function, the foot and ankle are inherently susceptable to injury resulting from the imposition of high-impact forces. When we are born, we have a thickened layer of tissue covering the plantar pads 31, ligaments 33, 34, sesamoids 32, and the tuberosity **24*a*** of the calcaneum. As we grow older we lose most of this protective padding. As a result, the entire weight-bearing and impact-absorbing mechanism of the foot is subjected to increased stress and the attendant increased likelihood of such injury.

Referring to FIG. 3, in normal standing the heel, or more precisely the tuberosity **24*a* of the calcaneum bone 24, receives about 60° of the weight and the forefoot about 40°. The phalanges take little weight in standing. By virtue of the natural arch 29, substantially the entire weight supported by the forefoot is borne by the heads of the metatarsals 23. In walking and running, the tuberosity 24 of the heel is the first part of the foot to bear to weight of the body. As the body moves forward, the weight shifts quickly to the forefoot, where it is taken up by the fifth metatarsal 23*b* and then in part by the remaining metatarsals 23, particularly the first metatarsal 23***a*.

I have found that by rather precisely locating cushions of the type described and claimed in my aforementoned U.S. Pat. No. 4,342,157 in the sole 41 of a shoe to be worn under conditions in which high-impact forces are encountered, I can greatly reduce the shock of such forces and thereby minimize the stress on the wearer's foot and ankle. Two criteria must be met in order to maximize the benefits. First, at least two separate cushions must be used in each shoe, one (cushion 51) in the forward portion of the sole, to protect the metatarsals 23, and a second (cushion 52) in the heel portion, to protect the wearer's heel. Second, the cushion 51 must be positioned under, and in alignment with the plantar pads 31 on the heads of the metatarsals 23. Preferably the cushiion 51 is rectangular in plan so that it is oriented substantially orthogonally with respect to the metatarsals 23. It may be formed with some other suitable plan shape, if the anatomy of the wearer's foot so requires. In most instances positioning the cushion 51 with its central major axis 51' forming an angle of from about 90° to about 100° with the imaginary straight line 53 connecting the center 31*b* of the plantar pad 31 of the wearer's fifth metatarsal 23*b* and the center 54 of the tuberosity 24*a* of the wearer's calcaneum has proved to be most satisfactory.

As seen in FIGS. 4 and 5, the shoe 65 embodying my current invention comprises a sole 66 constructed in multiple layers, generally with a bottom layer 67 of durable rubber or composition bearing a tread 68 for traction. Cavities 71, 72 conform closely to the outer dimensions of the bottom (not shown) and walls 73 of cushions 51, 52, which are partially filled with liquid 74. Layer 75 is laid over layer 67 and cemented to it under pressure, compressing the air in cushions 51, 52 and thereby maintaining their walls 73, covers 76 and bottoms in tight contact with the adjacent walls, tops and bottoms of cavities 71, 72.

It will be understood that the exact details shown and described have been selected for illustrative purposes, and obvious modifications can be made by a person skilled in the art without departing from the spirit or scope of the invention as it is definied in the following claims.

I claim:

1. A shoe, comprising:

a sole;

a first cavity in said sole, said first cavity being elongated in plan, having its central major axis coincident with the imaginary straight line extending between the centers of the plantar pads on the wearer's first and fifth metatarsals, and having walls, a roof and a floor;

a second cavity in said sole, said second cavity being positioned in registery with the tuberosity of the wearer's calcaneum, and having walls, a roof and a floor; and a sealed bladder confined within each of said cavities, comprising a thin, flexible, resilient non-porous shell having walls, a top and a bottom closely conforming to the walls, roof and floor of said cavity, said bladder containing a liquid under pressure whereby the walls, top and bottom of said shell are maintained in continuous intimate force-transmitting contact with the walls, roof and floor of said cavity.

2. The sole of claim 1 wherein said first and second cavities are generally rectangular in plan.

3. A shoe, comprising:

a sole;

a first cavity in said sole, said first cavity being elongated in plan, having its central major axis forming an angle of from about 90° to about 100° with the imaginary straight line extending between the center of the plantar pad on the wearer's fifth metatarsal and the center of the tuberosity of the wearer's calcaneum, and having walls, a roof and a floor;

a second cavity in said sole, said second cavity being positioned in registery with the tuberosity of the wearer's calcaneum, and having walls, a roof and a floor; and a sealed bladder confined within each of said cavities, comprising a thin, flexible, resilient non-porous shell having walls, a top and a bottom closely conforming to the walls, roof and floor of said cavity, said bladder containing a liquid under pressure whereby the walls, top and bottom of said shell are maintained in continuous intimate force-transmitting contact with the walls, roof and floor of said cavity.

4. The shoe of claim 3 wherein said first and second cavities are generally rectangular in plan.

5. A shoe sole, comprising:

a first cavity in said sole, said first cavity being elongated in plan, having its central major axis coincident with the imaginary straight line extending between the centers of the plantar pads on the wearer's first and fifth metatarsals, and having walls, a roof and a floor;

a second cavity in said sole, said second cavity being positioned in registery with the tuberosity of the wearer's calcaneum; and a sealed bladder confined within each of said cavities, comprising a thin, flexible, resilient non-porous shell having walls, a top and a bottom closely conforming to the walls, roof and floor of said cavity, said bladder containing a liquid under pressure whereby the walls, top and bottom of said shell are maintained in continuous intimate force-transmitting contact with the walls, roof and floor of said cavity.

6. The sole of claim 5 wherein said first and second cavities are generally rectangular in plan.

7. A shoe sole, comprising:

a sole;

a first cavity in said sole, said first cavity being elongated in plan, having its central major axis forming an angle of from about 90° to about 100° with the imaginary straight line extending between the center of the plantar pad on the wearer's fifth metatarsal and the center of the tuberosity of the wearer's calcaneum, and having walls, a roof and a floor;

a second cavity in said sole, said second cavity being positioned in registery with the tuberosity of the wearer's calcaneum; and a sealed bladder confined within each of said cavities, comprising a thin, flexible, resilient non-porous shell having walls, a top and a bottom closely conforming to the walls, roof and floor of said cavity, said bladder containing a liquid under pressure whereby the walls, top and bottom of said shell are maintained in continuous intimate force-transmitting contact with the walls, roof and floor of said cavity.

8. The sole of claim 7 wherein said first and second cavities are generally rectangular in plan.

9. A method for absorbing shock in a shoe, comprising:

forming in the sole of said shoe first and second cavities, said first cavity being elongated in plan, having its central major axis coincident with the imaginary straight line extending between the centers of the plantar pads on the wearer's first and fifth metatarsals, and having walls, a roof and a floor, said second cavity being positioned in registery with the tuberosity of the wearer's calcaneum, and having walls, a roof and a floor; and containing a sealed bladder within each of said cavities, said bladder containing a liquid under pressure whereby the walls, top and bottom of said shell are maintained in continuous intimate force-transmitting contact with the walls, roof and floor of said cavity.

10. A method for absorbing shock in a shoe, comprising:

forming in the sole of said shoe first and second cavities, said first cavity having its central major axis forming an angle of from about 90° to about 100° with the imaginary straight line extending between the center of the plantar pad on the wearer's fifth metatarsal and the center of the tuberosity of the wearer's calcaneum, and having walls, a roof and a floor, said second cavity being positioned in registery with the tuberosity of the wearer's calcaneum, and having walls, a roof and a floor; and containing a sealed bladder within each of said cavities, said bladder containing a liquid under pressure whereby the walls, top and bottom of said shell are maintained in continuous intimate force-transmitting contact with the walls, roof and floor of said cavity.

* * * * *